United States Patent [19]

Kulat

[11] Patent Number: 4,796,367

[45] Date of Patent: Jan. 10, 1989

[54] ADJUSTABLE, MANUAL SNOWPLOW

[76] Inventor: Andrew C. Kulat, 94 Petticoat La., Lebanon, N.J. 08833

[21] Appl. No.: 78,906

[22] Filed: Jul. 28, 1987

[51] Int. Cl.[4] ..... E01H 5/06

[52] U.S. Cl. ..... 37/273; 37/278

[58] Field of Search ..... 37/273, 272, 269, 278

[56] References Cited

U.S. PATENT DOCUMENTS

| | | | |
|---|---|---|---|
| 146,333 | 1/1874 | Gray | 37/273 |
| 163,501 | 5/1875 | Marshall | 37/272 |
| 194,386 | 8/1877 | Thatcher | 37/273 |
| 235,201 | 12/1880 | Bond | 37/269 |
| 482,720 | 9/1892 | Black | 37/273 |
| 637,712 | 11/1899 | Damerell | 37/267 |
| 731,419 | 6/1903 | Wykoff | 37/273 |
| 821,660 | 5/1906 | Masten | 37/269 |
| 924,810 | 6/1909 | Miller | 37/269 |
| 956,896 | 5/1910 | Gross | 37/273 |
| 1,049,812 | 1/1913 | Darling | 37/278 |
| 1,093,535 | 4/1914 | Civita et al. | 37/266 |
| 1,276,672 | 8/1918 | Mason, Jr. | 37/273 |
| 1,307,410 | 6/1919 | Morris | 37/273 |
| 1,331,382 | 2/1920 | Rolland | 37/269 |
| 1,393,724 | 10/1921 | Lackie | 37/269 |
| 1,480,504 | 1/1924 | Clark | 37/269 |
| 1,811,436 | 6/1931 | Luyster et al. | 37/269 |
| 1,927,196 | 9/1933 | Young | 37/266 |
| 2,014,783 | 9/1935 | Schubert | 37/278 |
| 2,119,443 | 5/1938 | Rogers | 37/278 |
| 2,345,460 | 3/1944 | Coderre | 37/269 |
| 2,637,261 | 5/1953 | Wale | 37/266 |
| 3,526,979 | 9/1970 | Ladewski | 37/273 |
| 4,005,475 | 5/1981 | Jarvis | 37/284 |

*Primary Examiner*—Eugene H. Eickholt

[57] ABSTRACT

The present invention is directed to an adjustable, manual snowplow which includes a pair of elongated blades, a width adjustment capability, a plowhead, a drive handle attachment, a drive handle, blade edges and at least one carrying handle. The panels are basically vertical-type blades and have a leading end and a trailing end and have enhanced blade edges located at the bottom of each. The panels are hingedly connected to one another at their leading ends and the plowhead is attached to at least one of the panels so as to permit the panels to be folded into one another. The drive handle attachment means permits the removal and attachment of the drive handle for easy carrying and the hinged arrangement of the leading ends of the panels permit compact carrying of the device. Optional wheels toward the trailing end of each of the panels as well as ballast weights to increase cutting power may be included. Last, the preferred embodiment includes fins which project out from the panels and cut into the snow during operation to prevent lifting of the trailing end of the panels.

6 Claims, 2 Drawing Sheets

ADJUSTABLE, MANUAL SNOWPLOW

BACKGROUND OF THE INVENTION

1. Field of the Invention

The present invention is directed to snowplows which are operable manually and, more particularly, to a manual snowplow which is compact and portable, as well as adjustable. While the snowplow of the present invention may be used to plow widths as wide as driveways, it is basically the type which may be operated by a single individual.

2. Prior Art Statement

The removal of snow has been a concern for centuries and became more important with the development of wheel drawn vehicles and, subsequently, motorized vehicles. The prior art is replete with literally hundreds of various designs for non-motorized snow removal devices. Thus, basic devices designed for pushing snow using a single blade in lieu of shoveling snow are set forth in U.S. Pat. Nos. 637,712; 1,093,535; 1,927,196; and, 2,637,261. These patents span from the turn of the century forward and represent typical manually operated snowplows. However, these are directed to such devices which are pushed, rather than pulled, and which are directed to those having single blade members In addition to the basic push-type snowplows developed for manual operation, in the late 1800's and early 1900's, a type of snowplow was developed which was known as the draft, which was designed to be horse drawn. These types of snowplows involved two blades instead of a single blade and many included adjustable width arrangements as well as devices for an operator to push in conjunction with a horse or team of horses pulling the device. Exemplary of these draft-type snowplows are U.S. Pat. Nos. 146,333; 163,501; 482,720; 821,660; 924,810; and, 1,331,382. While these do involve dual blades as well as adjustable width, none were designed for manual operation whereby a single operator would pull the device.

In addition to the types of snowplow technology discussed above, there has historically been push-type snowplows for manual operation which involve dual blades. Exemplary of patents representing these developments over the past century, are U.S. Pat. Nos. 194,386; 731,419; 956,896; 1,049,812; 1,307,410; and, 3,526,979. Again, these prior art references do include adjustable width arrangements for dual blades, but all involve push mechanisms for snow removal.

U.S. Pat. No 4,265,475 issued to Eugene R. Jarvis in 1981 describes a snow removal device which involves the pulling of a blade rather than the pushing of a blade by a single operator. However, this device is specifically directed to single blade operation with an adjustable pivot to change the blade angle, but does not include any advantages of the present invention device, such as adjustable width, dual blade mechanism.

Notwithstanding the formidable prior art directed to snowplow devices which span many decades, it appears that no prior art represents the improvement of the present invention involving a manual snowplow which is adjustable in width and which is specifically designed to be pulled rather than pushed. Due to the combination of running blade, ballast, optional wheels, nose guard and forward handle, it has been surprisingly discovered that the snowplow of the present invention may easily be operated by an individual of average strength without the kind of exertion necessary to move the push-type snowplows.

SUMMARY OF THE INVENTION

The present invention is directed to an adjustable, manual snowplow which includes a pair of elongated blades, a width adjustment capability, a plowhead, a drive handle attachment, a drive handle, blade edges and at least one carrying handle. The panels are basically vertical-type blades and have a leading end and a trailing end and have enhanced blade edges located at the bottom of each The panels are hingedly connected to one another at their leading ends and the plowhead is attached to at least one of the panels so as to permit the panels to be folded into one another. The drive handle attachment means permits the removal and attachment of the drive handle for easy carrying and the hinged arrangement of the leading ends of the panels permit compact carrying of the device. Optional wheels toward the trailing end of each of the panels as well as ballast weights to increase cutting power may be included. Last, the preferred embodiment includes fins which project out from the panels and cut into the snow during operation to prevent lifting of the trailing end of the panels.

BRIEF DESCRIPTION OF THE DRAWINGS

The present invention may be more fully understood with reference to the following description taken in conjunction with the drawings, wherein.

DETAILED DESCRIPTION OF THE PRESENT INVENTION

Figure 1:
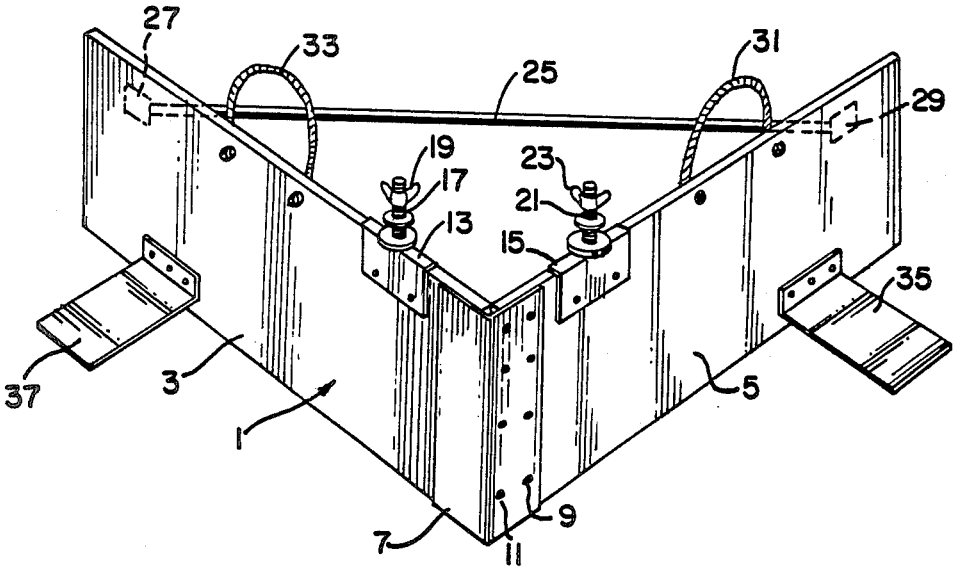
FIG. 1 shows a front perspective view of a portion of the snowplow of the present invention, excluding the handle.

Referring now to FIG. 1, there is shown a manual snowplow 1 of the present invention which includes a pair of elongated blade panels 3 and 5, each of said panels 3 and 5 having a substantially vertical plane blade surface, a leading end, a trailing end, a top and a bottom as shown. Panels 3 and 5 are connected to one another in a hinged fashion by hinges (not shown in this Figure). A plowhead 7 is shown which is located at the leading end of panels 3 and 5 and which is screwed to panel 5 by exemplary screws 9 and 11, but is not screwed to panel 3. This enables plowhead 7 to remain intact while blade 3 may be hingedly brought into parallel with blade 5 for easy carrying. Drive handle attachment means 13 and 15 are located on panels 3 and 5 respectively and include bolts 17 and 21 and wing nuts 19 and 23 for attachment and securing of a drive handle (not shown in this Figure). Width adjustment member 25 is shown and in this case comprises simply a rod which is permanently attached via hinge 27 and is hooked into panel 5 via plate 29. In this embodiment, the width adjustment member may be attached to various points along panel 5 to various eyelets, loops or other attachment means on the inside of panel 5 located along its top inside (not shown). Thus, width adjustment member 25 is a fixed length, but may be connected to panel 5 at various points so as to allow both angle adjustment and width adjustment of the panels 3 and 5. Carrying handles 31 and 33 are shown and are attached to panels 3 and 5 for easy carrying of snowplow 1 when in its folded position. These handles 31 and 33 are centrally located so as to create a balanced arrangement for carrying. Optional fins 35 and 37 are attached to panels 3 and 5 and these cut into the snow during operation and prevent the uplifting of the trailing ends of panels 3 and 5.

Figure 2:
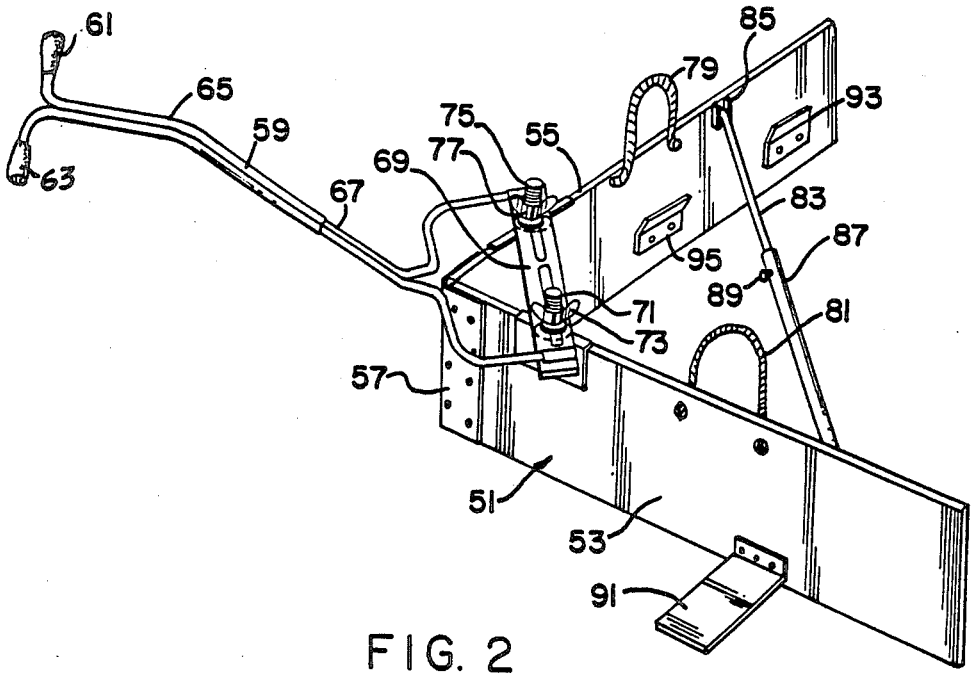
FIG. 2 shows a side perspective view of another embodiment of the snowplow of the present invention including the handle.

Referring now to FIG. 2, there is shown a snowplow 51 comprising panels 53 and 55 which are similar to panels 3 and 5 shown in FIG. 1. Likewise, plowhead 57 is shown which is similar to plowhead 7 shown in FIG. 1. Drive handle 59 is shown with elongated members 65 and 67 and gripping handles 61 and 63. Elongated member 67 includes an expanded section with a connecting member 69, such as a board or metal strip which includes slots for attachment via bolts 71 and 75 which are secured via wing nuts 73 and 77. Drive handle 59 may be disassembled by separation of elongated members 65 and 67 and by removal of wing nuts 73 and 77 to permit easy carrying, as well as convenient and compact storage. As shown, drive handle 59 extends forward beyond plowhead 57, rises upward and then rises forwardly again toward the grip end. This permits one or two operators to pull snowplow by either pulling at grips 61 and 63 or by pushing on grips 61 and 63. The critical feature here is that the device is operated by one or more individuals and, typically, a single individual, who is located in front of plowhead 57 and who creates motive power by pulling rather than pushing the plowhead through the snow. Additional features include width adjustment member 83 which is attached by attachment member 85 and which includes a telescopic section 87 which may be adjusted by tightening screw 9. Thus, width adjustment member 83 may simply be extended telescopically to the desired width. It is also attached to panel 53 in a removable fashion (not shown). Easy carrying handles 79 and 81 are similar to 31 and 33 shown in FIG. 1. Ballast members 93 and 95 are shown on panel 55 and equivalent ballasts would be included on the inside of panel 53 to weigh down the panels 53 and 55 to eliminate or, in many instances, prevent the trailing ends of panels 53 and 55 from rising up during operation.

Figure 3:
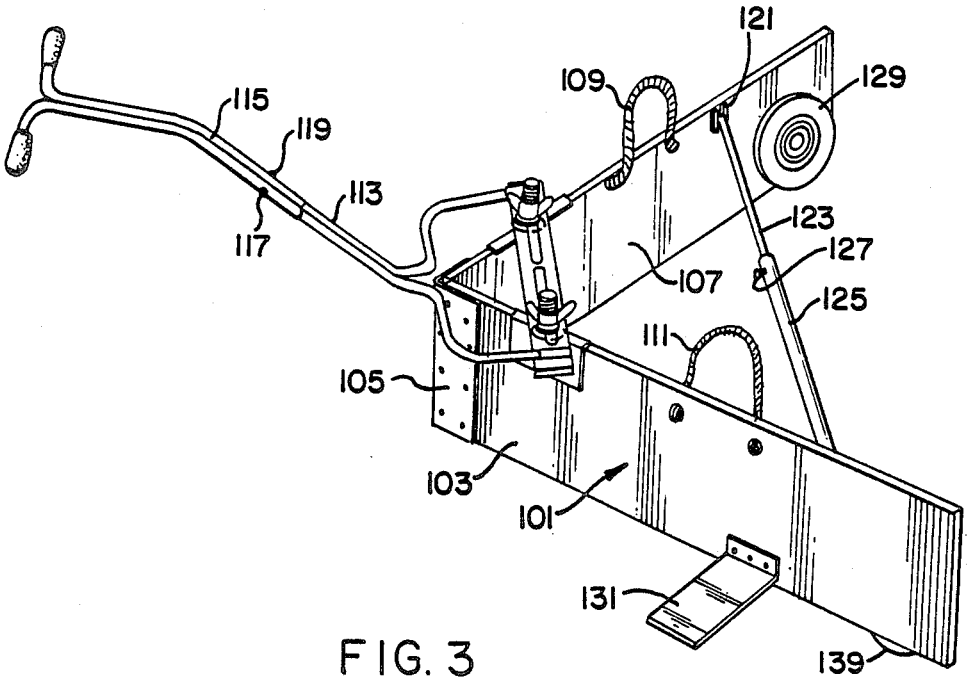
FIG. 3 shows a third embodiment of the snowplow of the present invention including wheels; and, FIG. 4 shows a rear perspective view of the snowplow shown in FIG. 3, but exclusive of the handle and part of the attachments for the drive handle.

Referring now to FIG. 3, there is shown snowplow 101 having panels 103 and 107 and plowhead 105. Handles 109 and 111 are included and drive handle 113 is shown having an upper member 115 with adjustment screws 117 and 119. These permit drive handle 113 to be extended in length for various heights of operators and permit the breakdown of drive handle 113 into two parts for easier carrying and storage. Width adjustment member 123 includes telescopic section 125 and adjustment screw 127. Also included in this embodiment are wheels 129 which may be removably or adjustably located thereon so as to allow slight clearance and so as to enhance the movement of the snowplow 101 during operation.

Figure 4:
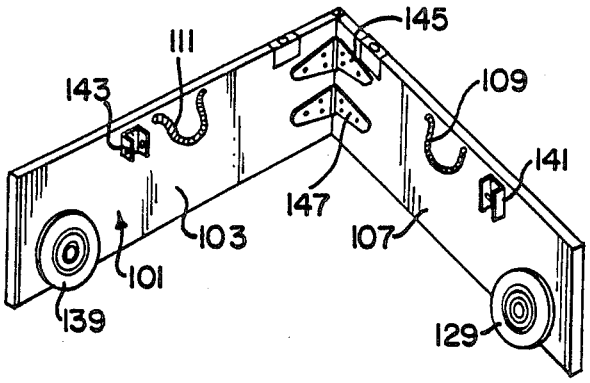

FIG. 4 shows a perspective view of the back side of snowplow 101 and like parts are like numbered. Note that hinge members 145 and 147 are specifically shown.

All of the panels in the Figures set forth above will have blade edges which may comprise simply the bottom portion of the panels themselves or may comprise edges which constitute additional members. Thus, the panels may be formed of metal, wood, plastic or other material and the blade edges may be of like material, may be unistructurally incorporated, therein, or may be of different materials, e.g. steel or other metals, and may be embedded, bolted., riveted or otherwise attached to the bottoms of the panels Thus, the expression "blade edges" as used herein are taken to mean both bottom edges of panels as well as the enhancement of the bottom edges of such panels by the inclusion of additional blade members Obviously, numerous modifications and variations of the present invention are possible in light of the above teachings. It is therefore understood that within the scope of the appended claims, the invention may be practiced otherwise than as specifically described herein.

What is claimed is:

1. An adjustable, manual snowplow, which comprises:

(a) a pair of elongated blade panels each of said panels having a substantially vertical plane blade surface, a leading end, a trailing edge, a top and a bottom, said panels being connected to one another in a hinged fashion at their leading ends so as to open and close relative to one another to form a vee shape;

(b) at least one set of hinges attached to the leading ends of the pair of elongated blade panels on the inside of the vee;

(c) a width adjustment member connecting said pair of panels to one another towards their trailing end so as to establish a plow path width, said adjustment member being at least partially removable so as to permit said panels to be folded into one another;

(d) a rigid plow head located on the outside of the leading end of both of said panels and attached to only one of said panels so as to permit said panels to be folded into one another;

(e) drive handle attachment means located on said panels toward the leading end of said panels;

(f) a drive handle attached to said drive handle attachment means, said drive handle being located forward of said leading ends of said panels and having adequate length to permit manual pushing by an operator located in front of said leading ends of said panels;

(g) at least one handle centrally located on a panel to enable said snowplow to be carried manually when folded; and, (h) blade edges located at the bottom of each of said pair of panels.

2. The snowplow of claim 1 wherein said drive handle is segmented into at least two portions to permit collapse of said drive handle for compactness.

3. The snowplow of claim 1 further including ballast weights located toward the trailing end of each of said panels.

4. The snowplow of claim 1 further including wheels on each said panels, said wheels having an operable location for ground contact and having a storage location.

5. The snowplow of claim 1 wherein said width adjustment member has telescopic segments to permit infinite width adjustment within its length, and having locking means to permit locking at a selected width.

6. The snowplow of claim 1 further comprising at least one snow-cutting fin located on the outside of each of said panels biased toward the bottom of each of said panels.

* * * * *